US005598055A

United States Patent [19]

Inoue et al.

[11] Patent Number: 5,598,055

[45] Date of Patent: Jan. 28, 1997

[54] DEFLECTION DEVICE FOR USE IN A COLOR CATHODE-RAY TUBE

[75] Inventors: Masatsugu Inoue; Kumio Fukuda, both of Fukaya; Nobuhiko Akoh, Gunma-ken; Tohru Takahashi, Kumagaya; Norio Shimizu, Fukaya, all of Japan

[73] Assignee: Kabushiki Kaisha Toshiba, Kawasaki, Japan

[21] Appl. No.: 46,993

[22] Filed: Apr. 16, 1993

[30] Foreign Application Priority Data

Apr. 17, 1992 [JP] Japan ..... 4-096882
Aug. 14, 1992 [JP] Japan ..... 4-216242

[51] Int. Cl.[6] ..... H01J 29/70

[52] U.S. Cl. ..... 313/440; 335/213

[58] Field of Search ..... 313/440, 428, 313/432; 335/210–213, 296

[56] References Cited

U.S. PATENT DOCUMENTS 4,233,582 11/1980 Abe et al. ..... 335/213
5,177,399 1/1993 Fujiwara et al. ..... 313/440
5,177,412 1/1993 Morohashi et al. ..... 315/370
5,179,319 1/1993 Iwasaki et al. ..... 313/440

FOREIGN PATENT DOCUMENTS 59-184439 10/1984 Japan .
61-281441 12/1986 Japan .
1161644 6/1989 Japan .

*Primary Examiner*—Stephen Brinich
*Attorney, Agent, or Firm*—Cushman Darby & Cushman, L.L.P.

[57] ABSTRACT

A deflection device for use in a color cathode-ray tube, which has a pair of horizontal deflection coils for generating a pincushion-shaped horizontal deflection magnetic field, a pair of vertical deflection coils for generating a barrel-shaped vertical deflection magnetic field. The deflection device also having a pair of correction coils each of which being located at a distance of 10 mm or less from a plane containing the center and vertical axes of the device, a current flowing through each correction coil in synchronism with, and in a direction opposite to, the currents flowing in the horizontal deflection coils. The deflection device may also include a second pair of correcting coils, each of which being located adjacent to the first pair of correcting coils and arranged in a similar arrangement relative to the plane defined by the center and vertical axes.

5 Claims, 6 Drawing Sheets

DEFLECTION DEVICE FOR USE IN A COLOR CATHODE-RAY TUBE

BACKGROUND OF THE INVENTION

1. Field of the Invention

The present invention relates to a deflection device for use in an in-line color cathode-ray tube, which is designed to deflect three electron beams passing in the same plane, and more particularly to a deflection device which has a convergence-correcting coil for eliminating mis-convergence in an in-line color cathode-ray tube of a self-convergence type.

2. Description of the Related Art

Most color cathode-ray tubes have the structure shown in FIG. 1. As shown in FIG. 1, each tube comprises an envelope 2 formed of a panel 1 and a funnel 9 integral with the panel 1. It further comprises a phosphor screen 3 formed on the inner surface of the panel 1, a shadow mask 4 located in the envelope 2, an electron gun unit 8 located in the neck 6 of the envelope 2, and a deflection device 10 surrounding the adjoining portions of the neck 6 and large-diameter portion 9 of the envelope 2. The screen 3 consists of blue-light emitting phosphor stripes, green-light emitting phosphor stripes, and red-light emitting phosphor stripes. The shadow mask 4 opposes the phosphor screen 3 and has a number of apertures. The electron gun unit 8 has three electron guns for emitting three electron beams 7B, 7G, and 7R, respectively, toward the phosphor screen 3. The deflection device 10 is designed to generate horizontal and vertical deflection magnetic fields. The electron beams 7B, 7G, and 7R emitted from the gun unit 8 are deflected by the deflection magnetic fields generated by the unit 10, then pass through the apertures of the shadow mask 4, and finally applied to the phosphor screen 3. Excited by the beams 7B, 7G, and 7R, the phosphor stripes of the screen 3 emit blue light rays, green light rays, and red light rays. As a result, the cathode-ray tube displays a color image.

The electron gun unit 8 is a so-called "in-line type" designed to emit three electron beams, i.e., a center beam 7G and two side beams 7B and 7R which pass in the same plane. The horizontal deflection magnetic field generated by the unit 10 is shaped like a pin-cushion as is shown in FIG. 2A. By contrast, the vertical deflection magnetic field generated from the device 10 is shaped like a barrel as is illustrated in FIG. 2B. The magnetic fluxes 12H of the pincushion-shaped magnetic field deflects the electron beams 7B, 7G, and 7R in a horizontal plane, while the magnetic fluxes 12v of the barrel-shaped magnetic field deflects the electron beams 7B, 7G, and 7R in a vertical plane.

Self-convergence type in-line color cathode-ray tubes, described above, are commonly used in practice.

As FIG. 1 shows, the deflection device 10 comprises a horizontal deflection coil 13H for generating the pincushion-shaped horizontal deflection magnetic field, and a vertical deflection coil 13v for generating the barrel-shaped vertical deflection magnetic field. Generally, the coils 13H and 13V are a saddle type and a toroidal type, respectively. The pincushion-shaped horizontal deflection magnetic field 12H converges the electron beams 7B, 7B, and 7R toward one another in the horizontal plane extending in an x axis, whereas the barrel-shaped vertical deflection magnetic field 12V converges the electron beams 7B, 7B, and 7R toward one another in the vertical plane extending in a y axis.

Even if the beams 7B, 7B, and 7R are so converged by the pincushion-shaped magnetic field 12H and the barrel-shaped magnetic field 12V, however, misconvergence of the beams occurs at the corners of a display screen 14 as shown in FIG. 3. In other words, a blue-beam spot 15B, a green-beam spot 15G, and a red-beam spot 15R are vertically displaced from one another at the corners of the display screen 14. In most cases, the mis-convergence can be eliminated by adjusting the distance between the deflection center of the horizontal deflection coil 13H and that of vertical deflection coil 13V.

As has been indicated, the deflection device 10 generates a horizontal deflection magnetic field 12H shaped like a pincushion, and a vertical deflection magnetic field 12V shaped like a barrel. Hence, the three electron beams 7B, 7G, and 7R can be converged at any position in the horizontal and vertical axes of the display screen 14. As shown in FIG. 4, however, mis-convergence of the beams takes place in intermediate regions between the corners and the horizontal and vertical axes of the screen 14. The red-beam spot 15R, for example, is formed closer to the center of the screen 14 than the blue-beam spot 15B in the right half of the screen 14, and is located farther from the center of the screen 14 than the blue-beam spot 15B in the left half of the screen 14. The mis-convergence of the electron beams inevitably deteriorates the quality of the image the cathode-ray tube displays.

The mis-convergence occurring at a position between the vertical axis y of the screen 14 and the any corner thereof may be minimized by altering the distribution of the magnetic fluxes generated by the deflection device 10 distribution. In this case, the mis-convergence is increased in the corners of the screen. Consequently it is no longer possible to improve the quality of the image displayed.

Recently, not only the distance between the deflection centers of the deflection coils 13H and 13V is adjusted, but also a saturable reactor is used, varying, differentially at the vertical deflection frequency, the horizontal-deflection currents supplied to the upper and lower coils constituting the horizontal deflection coil 13H. Mis-convergence in any corner of the screen 14 is eliminated almost completely. Mis-convergence can, therefore, be sufficiently reduced at any position in the horizontal and vertical axes of the screen 14 and at any corner thereof, but not at a position between the vertical axis y of the screen 14 and the any corner thereof. That is, as shown in FIG. 4, mis-convergence remains between the axis y and each corner, such that the red-beam spot 15R is located farther to the center of the screen 14 than the blue-beam spot 15B in the right half of the screen 14, and is located nearer the center of the screen 14 than the blue-beam spot 15B in the left half of the screen 14. The display screen 14, as a whole, has but poor convergence characteristic.

The mis-convergence occurring between the axis y of the screen 14 and each corner thereof can be reduced by two alternative methods. The first is to alter the distribution of deflection magnetic fluxes. The second is said same method used to minimize the mis-convergence at the corners of the screen 14. If either alternative method is performed, however, a prominent mis-convergence will occur at each corner of the display screen 14, inevitably degrading the convergence all over the display screen 14.

With the conventional method of eliminating or reducing mis-convergence in an in-line cathode-ray tube of self-convergence type, it is impossible to minimize the mis-convergence between the axis y of the screen 14 and each corner thereof, without degrading the convergence all over the display screen 14.

SUMMARY OF THE INVENTION

The object of this invention is to provide a deflection device for use in an in-line color cathode-ray tube of self-convergence type, which can much reduce not only mis-convergence at any point in the horizontal and vertical axes of the screen of the tube and at any corner of the screen but also mis-convergence at intermediate regions between the corners and the horizontal and vertical axes.

According to the invention, there is provided a deflection device for use in a color cathode-ray tube having a center axis and means for emitting in-line electron beams, comprising:

horizontal deflection means for deflecting the electron beams in a horizontal direction in response to horizontal deflection signals, said horizontal deflection means including a pair of horizontal deflection coils for generating a pincushion-shaped horizontal deflection magnetic field:

vertical deflection means for deflecting the electron beams in a vertical direction in response to vertical deflection signals, said vertical deflection means including a pair of vertical deflection coils for generating a barrel-shaped vertical deflection magnetic field; and correction means for correcting the deflection of the electron beams by applying a correction magnetic field to the electron beams in response to the horizontal deflection signals, said correction means including a pair of correction coils which are located near a vertical axis orthogonal to said center axis and symmetrically with respect to the vertical axis and in which currents flow in synchronism with, and in a direction opposite to, the currents flowing in said horizontal deflection coils.

According to the invention, there is also provided a deflection device for use in a color cathode-ray tube having a center axis and means for emitting in-line electron beams, comprising:

horizontal deflection means for deflecting the electron beams in a horizontal direction in response to horizontal deflection signals, said horizontal deflection means including a pair of horizontal deflection coils for generating a pincushion-shaped horizontal deflection magnetic field;

vertical deflection means for deflecting the electron beams in a vertical direction in response to vertical deflection signals, said vertical deflection means including a pair of vertical deflection coils for generating a barrel-shaped vertical deflection magnetic field; and correction means for correcting the deflection of the electron beams by applying a correction magnetic field to the electron beams in response to the horizontal deflection signals, said correction means including a first pair of correction coils which are located near a vertical axis orthogonal to said center axis and symmetrically with respect to the vertical axis and in which currents flow in synchronism with, and in a direction opposite to, the currents flowing in said horizontal deflection coils, and a second pair of correction coils which are located near said vertical axis and symmetrically with respect to said vertical axis and in which currents flow in synchronism with, and in the same direction as, the currents flowing in said horizontal deflection coils.

In an another aspect of the invention, there is provided a deflection device comprising: a pair of horizontal deflection coils for generating a pincushion-shaped horizontal deflection magnetic field; a pair of vertical deflection coils for generating a barrel-shaped vertical deflection magnetic field; and a pair of correction coils which are located a deflection region spaced by 10 cm or less from a plane containing the axis of the device and a vertical axis extending at right angles to the axis of the device and in which currents flow in synchronism with and in an opposite direction to currents flowing in the horizontal deflection coils.

Located in the deflection region spaced by 10 cm or less from a plane containing the axis of the device and a vertical axis extending at right angles to the axis of the device and in which currents flow in synchronism with and in an opposite direction to currents flowing in the horizontal deflection coils, the correction coils generate a magnetic field which deflects the outermost side electron beam more than the innermost side beam in a horizontal plane, the outermost side beam being positioned more apart from the tube axis than the innermost side beam, when the electron beams are directed to the intermediate positions between the vertical axis of the screen and any corner thereof. The innermost side beam is more deflected than the outermost beam by the pincushion-shaped horizontal deflection magnetic field generated by the horizontal deflection coils, when the electron beams are directed to the corners of the screen. Hence, the correction coils can minimize the mis-convergence between the vertical axis of the screen and each corner of the screen, without degrading the convergence all over the display screen.

In yet another aspect of this invention, there is provided a deflection device for deflecting three electron beams passing in the same plane, comprising: a deflection yoke having a saddle-shaped horizontal deflection coil for generating a pincushion-shaped horizontal deflection magnetic field for deflecting the three electron beams toward one another in a horizontal plane; a vertical deflection coil generating a barrel-shaped vertical deflection magnetic field for deflecting the three electron beams toward one another in a vertical plane; a first coil which is located at the rear of the deflection yoke and in a plane containing the central axis and vertical axis of the deflection yoke and in which a current flows in synchronism with and in an opposite direction to a current flowing in the horizontal deflection coil; and a second coil which is located in front of the deflection yoke and in a plane containing the central axis and vertical axis of the deflection yoke and in which a current flows in synchronism with and in the same direction as a current flowing in the horizontal deflection coil.

Since the first coil is located in the position described above, and a current flows in this coil in the direction specified above, the first coil generates a magnetic field which reduces the vertical mis-convergence remaining between the vertical axis of a display screen and each corner thereof. Since the second coil is located in the position described above, and a current flows in the second coil in the direction specified above, the second coil generates a magnetic field which reduces the horizontal mis-convergence caused by the first coil and remaining between the vertical axis of a display screen and each corner thereof. Hence, the first coil and the second coil cooperate to effectively minimize the mis-convergence occurring at a position between the vertical axis of a display screen and each corner thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
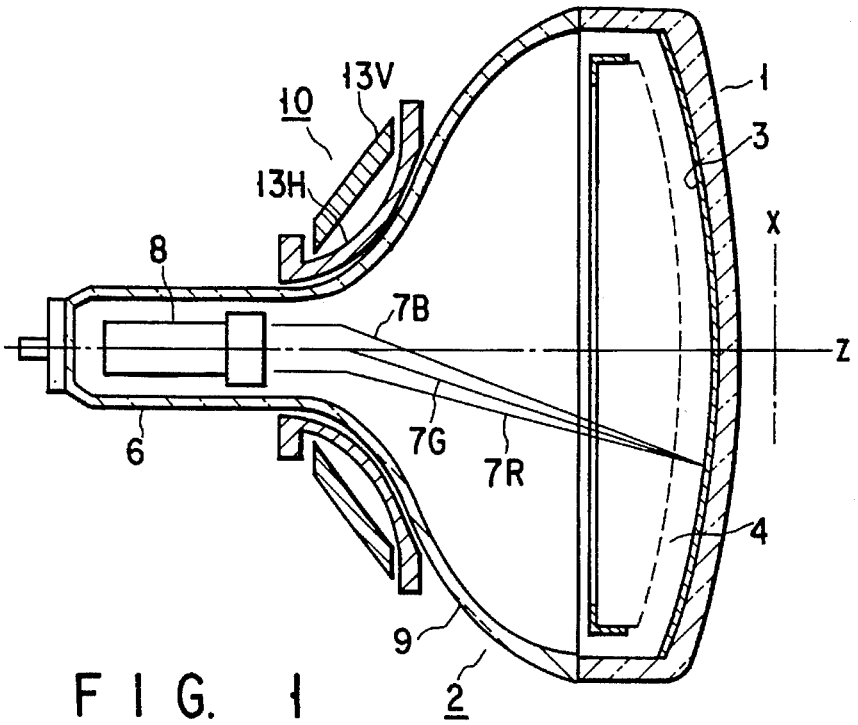
FIG. 1 (PRIOR ART)
FIG. 1 is a cross-sectional view schematically showing a conventional color cathode-ray tube.
Figure 2A:
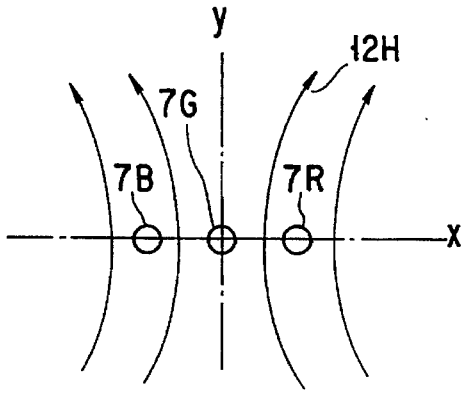
FIG. 2A (PRIOR ART)
FIG. 2A is a diagram illustrating a pincushion-shaped horizontal deflection magnetic field generated by a deflection device for use in an in-line color cathode-ray tube of self-convergence type.
Figure 2B:
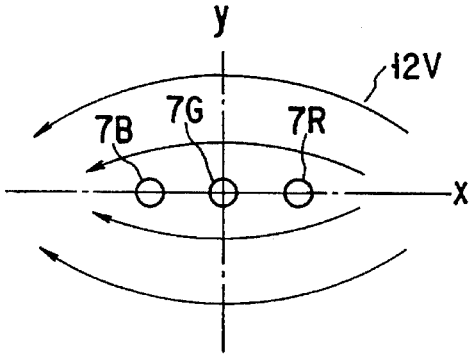
FIG. 2B (PRIOR ART)
FIG. 2B is a diagram showing a barrel-shaped horizontal deflection magnetic field generated by the deflection device for use in an in-line color cathode-ray tube of self-convergence type.
Figure 3:
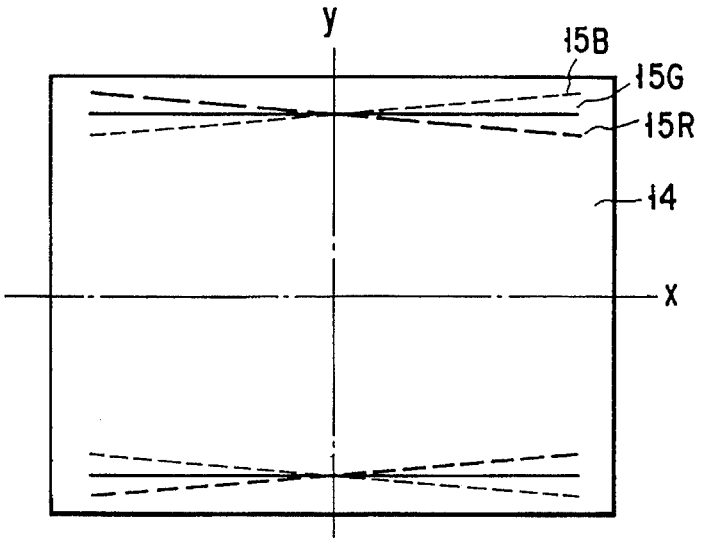
FIG. 3 (PRIOR ART)
FIG. 3 is a diagram explaining mis-convergence occurring at the corners of the display screen of an in-line cathode-ray tube of self-convergence type.

Embodiments of the present invention, each being a deflection device for use in an in-line cathode-ray tube of the type shown in FIG. 1, will be described, with reference to the accompanying drawings.

Figure 5A:
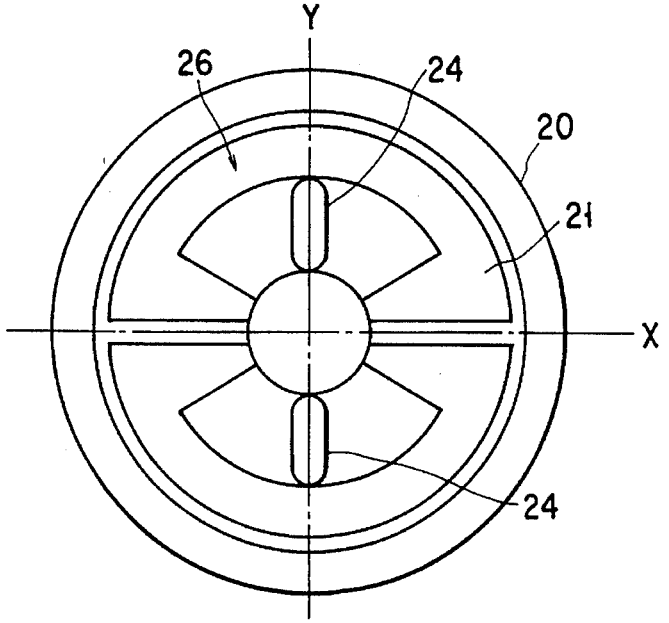
FIG. 5A is a front view of a deflection device according to a first embodiment of the invention, which is designed for use in an in-line cathode-ray tube of self-convergence type.
Figure 5B:
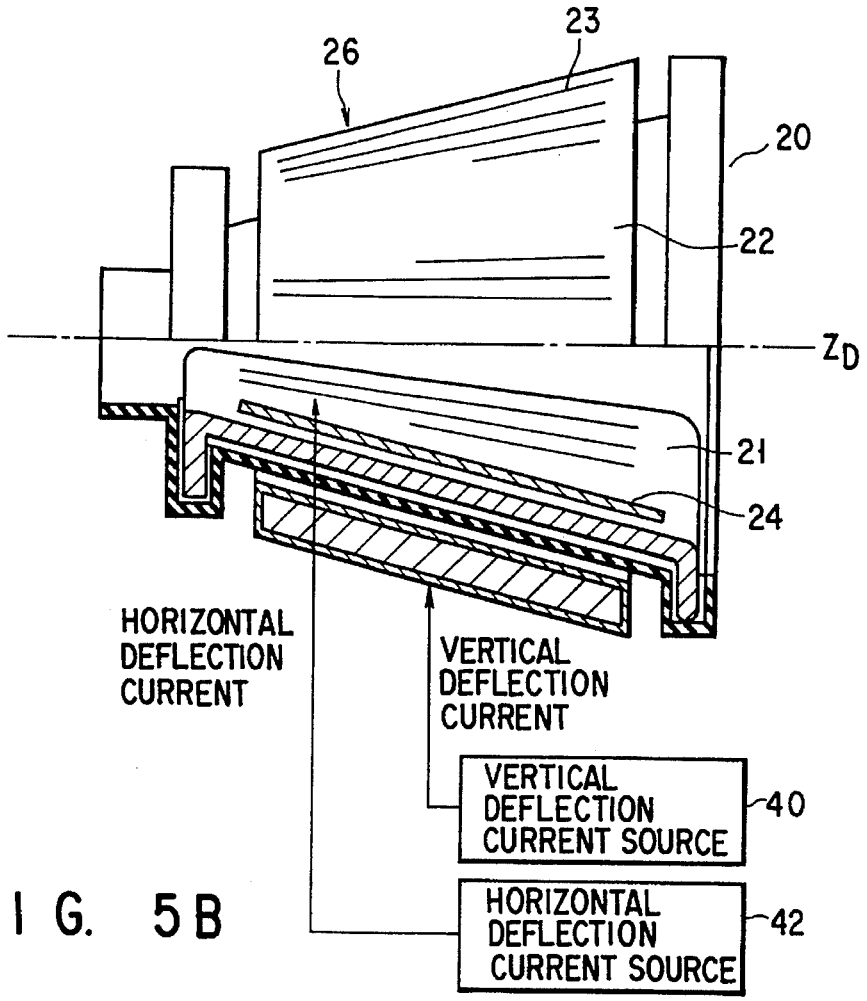
FIG. 5B is a partly broken-away, side view of the deflection device shown in FIG. 5A.

FIGS. 5A and 5B show a deflection device according to a first embodiment of the present invention. This deflection device comprises a separator 20 made of synthetic resin. The separator 20 will serve as part of the envelope of an in-line cathode-ray tube. It is generally a tapered hollow cylinder, whose small-diameter end and large-diameter ends are to be fixed to the neck and funnel of the envelope the cathode-ray tube, respectively.

Inside the separator 20, a pair of saddle-shaped horizontal deflecting coils 21 are located. A tapered, hollow cylindrical core 22 is mounted on the separator 20 and positioned coaxial therewith. A pair of toroidal vertical deflection coils 23 are wound around the core 22. The horizontal deflection coils 21 and the vertical deflection coils 23 constitute a deflection coil 27. The horizontal deflection coils generate a pincushion-shaped horizontal deflection magnetic field, whereas the vertical deflection coils 23 generate a barrel-shaped vertical deflection magnetic field.

The deflection device further comprises a pair of correction coils 24, i.e., an upper correction coil and a lower correction coil. Each correction coil 24 is placed in a plane Z-Y which contains the axis $Z_D$ of the deflection device and a vertical line extending at right angles to the axis $Z_D$. As is evident from FIG. 5A, the halves of each turn of either correction coil 24 extend substantially parallel to the plane Z-Y and are symmetrical with respect thereto.

The vertical deflection coils 23 are connected to a vertical deflection current source 40, and the horizontal deflection coils 21 and the correction coils 24 are connected to a horizontal deflection current source 42. The correction coils 24 are connected to the horizontal deflection coils 21 such that a current flows in the coils 24 in synchronism with the current flowing in the horizontal deflection coils 21, and in the direction opposite to the direction in which the current flows in the coils 21.

Figure 6:
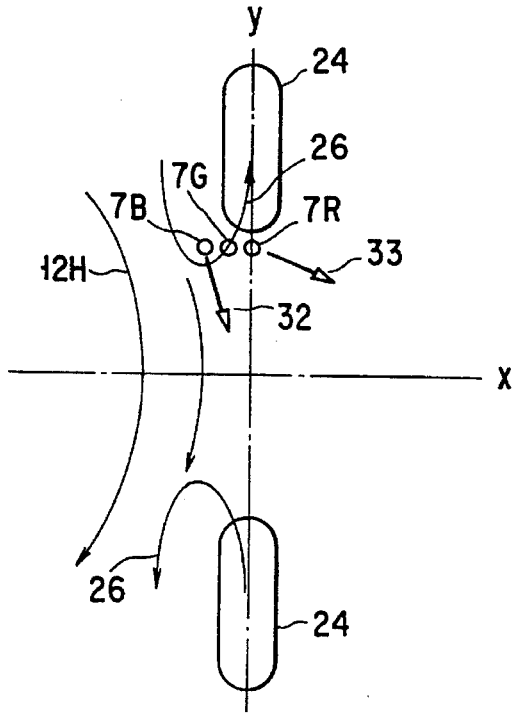
FIG. 6 is a diagram explaining how the deflection device shown in FIGS. 5A and 5B reduces mis-convergence.

Assume that the deflection device of FIGS. 5A and 5B is incorporated in an in-line cathode-ray tube, and that currents simultaneously flow in the horizontal deflection coils 21 and the correction coils 24 in the directions specified above. Then, as shown in FIG. 6, the horizontal deflection coils 21 generate horizontal deflection magnetic fields 12H in a deflection region in which the three electron beams 7B, 7G, and 7R emitted from the electron gun unit of the cathode-ray tube. Simultaneously, the correction coils 24 generate correction magnetic fields 26 in the same deflection region. Since either correction magnetic field is a local one, the beams 7B, 7G, and 7R are deflected in different directions which are determined by the positions they take with respect to the correction field.

More precisely, when the deflecting magnetic field deflects the beams 7B, 7B, and 7R to an intermediate position between the vertical axis of the display screen of the cathode-ray tube and the upper-left corner of the display screen, the correction magnetic field 26 deflects the side beam 7B more than the other side beam 7R toward the horizontal axis, as can be understood from the arrows 32 and 33 shown in FIG. 6. When the deflecting magnetic field deflects the beams 7B, 7G, and 7R to the upper-left corner of the display screen, the correction magnetic field 26 deflects the side beam 7B more toward the vertical axis and the side beam 7R more toward the horizontal axis than in the case where the beams 7B, 7G, and 7R are deflected to an intermediate position between the vertical axis of the screen and the upper-left corner thereof.

In contrast, when the deflecting magnetic field deflects the beams 7B, 7G, and 7R to an intermediate position between the vertical axis of the screen and the upper-right corner thereof, the side beams 7B and 7R are deflected in a relation reverse to the relation in which they are deflected in when the three beams are deflected to the left edge of display screen. When the deflecting magnetic field deflects the beams 7B, 7G, and 7R to the lower edge of the display screen, the side beams 7B and 7R are deflected in a relation same as the relation in which they are deflected when the three beams are deflected to the upper edge of display screen.

Figure 4:
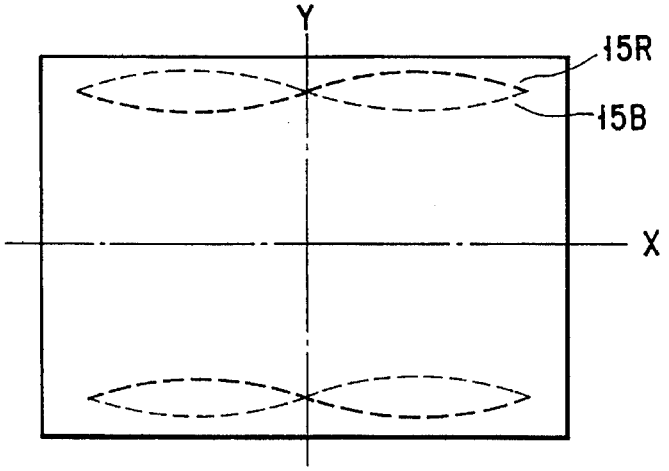
FIG. 4 (PRIOR ART)
FIG. 4 is a diagram explaining mis-convergence remaining even after correcting the mis-convergence at the corners of the display screen of the in-line cathode-ray tube of self-convergence type.

Namely, since currents flow through the correction coils 24 at the same time as the current in the horizontal deflection coils 21 and in the opposite direction thereto, the vertical mis-convergence (FIG. 4) at a position between the vertical axis and any corner of the screen can be much reduced, without jeopardizing the convergence at the corners of the screen. As a result, good convergence is attained at any position on the display screen.

A deflection device according to this invention was made for operating test. In the device, two correction coils 24 were positioned such that their two-turn windings were located at the distance of 5 mm from the vertical axis of the deflection device. The device was incorporated into a 23-inch, 110° color cathode-ray tube, and the cathode-ray tube was operated. Mis-convergence of 0.5 mm was seen at each corner of the display screen. Simultaneously, mis-convergence of 0.7 mm in the same direction was observed at any position between the vertical axis and each corner of the display screen of the cathode-ray tube. The mis-convergence at any position between the vertical axis and each corner is less than half the mis-convergence occurring in the case where a conventional deflection device without correction coils is employed.

The use of the correction coils 24 increases the horizontal mis-convergence. This mis-convergence, however, can be minimized merely by adjusting the distribution of the horizontal deflection magnetic field.

In the first embodiment, the correction coils 24 were so positioned that their windings were 5 mm away from the vertical axis of the device. Nonetheless, the windings may be located closer to or farther from the vertical axis. They should not be positioned, however, at a distance exceeding 10 mm from the plane containing the vertical axis and center axis of the deflection device. If the distance is more than 10 mm, the magnetic field the correction coils 24 generate can no longer serve to reduce the mis-convergence occurring at any position between the vertical axis and each corner of the display screen.

The more turns each correction coil 24 has, the more greatly the coil 24 serves to reduce the mis-convergence. An increase in the number of turns, however, may reduce the deflection angle of the electron beams 7B, 7G, and 7R and may adversely influence the characteristics of the deflection device. The mis-convergence at a midpoint between the vertical axis and each corner of the screen is about 1 to 2 mm in most cases. It would therefore suffices to reduce the mis-convergence by about 1 to 2 mm. In view of this, it is required that the correction coils 24 have five or less turns each.

Two modifications of the deflection device shown in FIGS. 5A and 5B will be described, with reference to FIGS. 7A and 7B.

In the device of FIGS. 5A and 5B, the correction coils 24, positioned in the plane Z-Y, are shaped such that the halves of each turn of either coil 24 extend parallel to the plane Z-Y and are symmetrical with respect thereto as is evident from FIG. 5A. Instead, as is shown in FIG. 7B, the correction coils 24 may be shaped such that each turn may gradually deviate from the Z-Y plane as it extends toward the large-diameter end of the separator 20. Conversely, the coils 24 may be shaped such that each turn may gradually approach the Z-Y plane as it extends toward the large-diameter end of the separator 20.

Figure 7A:
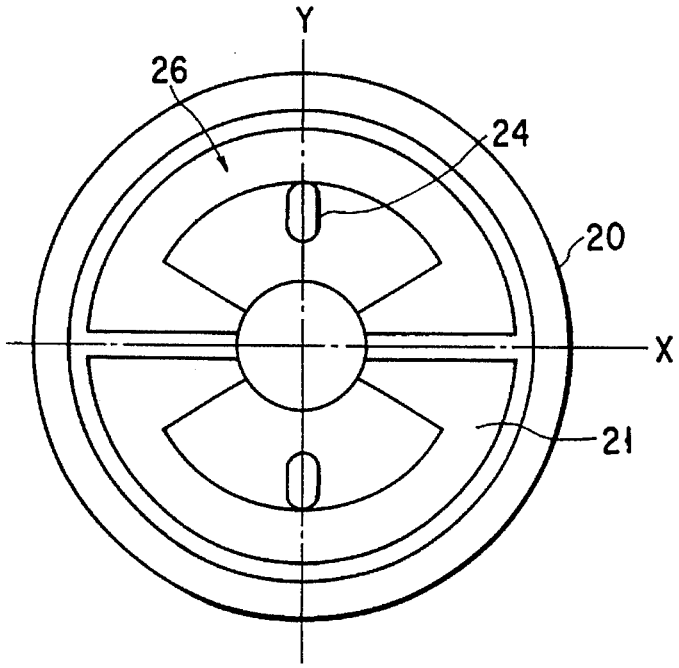
FIGS. 7A and 7B are front views showing modifications of the deflection device shown in FIGS. 5A and 5B.
Figure 7B:
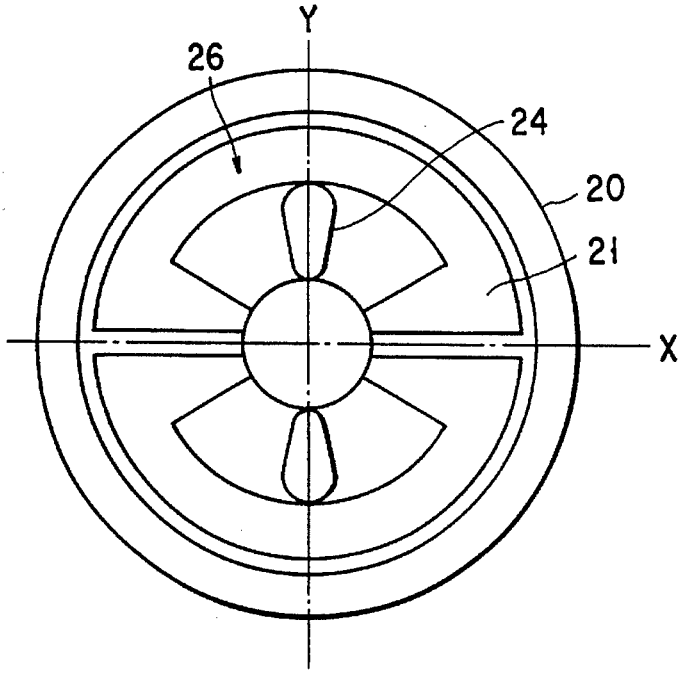

In the modification of FIG. 7A, the correction coils 24 may be located in the large-diameter end portion of the separator 20.

As has been indicated, the deflection device of FIGS. 5A and 5B, designed for use in a color cathode-ray tube, comprises a pair of horizontal deflection coils 21 for generating a pincushion-shaped horizontal deflection magnetic field and a pair of vertical deflection coils 23 for generating a barrel-shaped vertical deflection magnetic field. It further comprises a pair of correction coils 24, which are spaced by 10 mm or less from the plane containing the axis of the device and a vertical axis extending at right angles to the axis of the device. Currents flow in these coils 24, in synchronism with and in an opposite direction to the currents flowing in the horizontal deflection coils 21, whereby the coils 24 generate a magnetic field. This magnetic field deflects the side beams (i.e., two of the three electron beams emitted from the electron bun unit of the cathode-ray tube), in a specific manner. That is, when the electron beams are directed to the intermediate positions between the vertical axis and the each corners of the screen, the outermost side beam which is positioned more remote from the tube axis that the innermost side beam or center beam is more deflected toward the horizontal axis than the other innermost side beam. In contrast, when the electron beams are directed to the any corner of the screen, the innermost is more deflected toward the horizontal axis than the outermost side beam. As a result, the mis-convergence at any position between the vertical axis and each corner of the screen can be minimized, without degrading the convergence at each corner of the display screen. Good convergence of electron beams is attained at any position on the display screen of the cathode-ray tube.

Another deflection device according to the present invention will be described, with reference of FIGS. 8A, 8B, and 9.

Figure 8A:
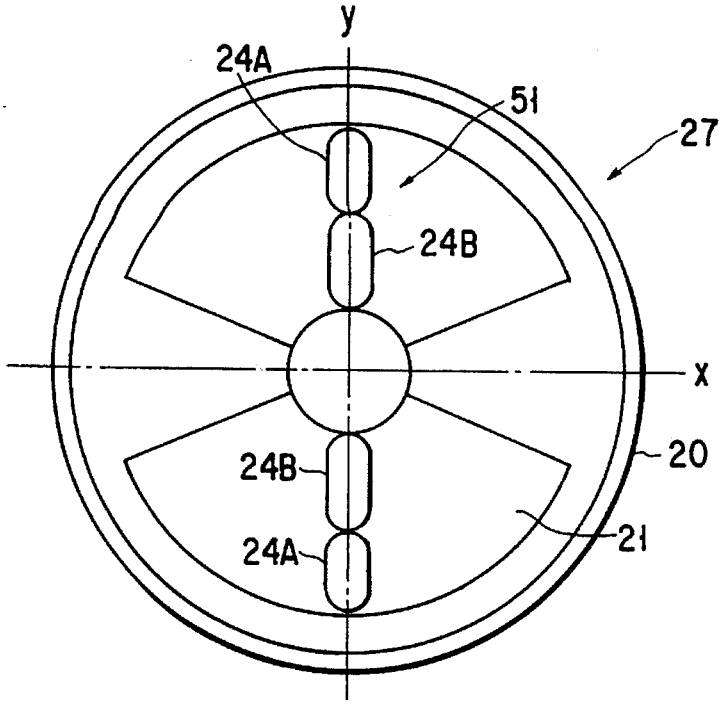
FIG. 8A is a front view of a deflection device according to a second embodiment of the invention, which is designed for use in an in-line cathode-ray tube of self-convergence type.
Figure 8B:
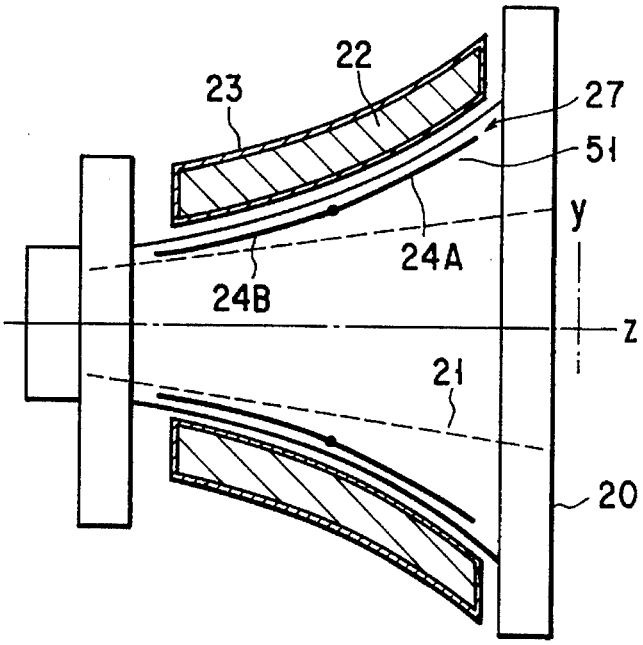
FIG. 8B is a partly broken-away, side view of the deflection device shown in FIG. 8A.
Figure 9:
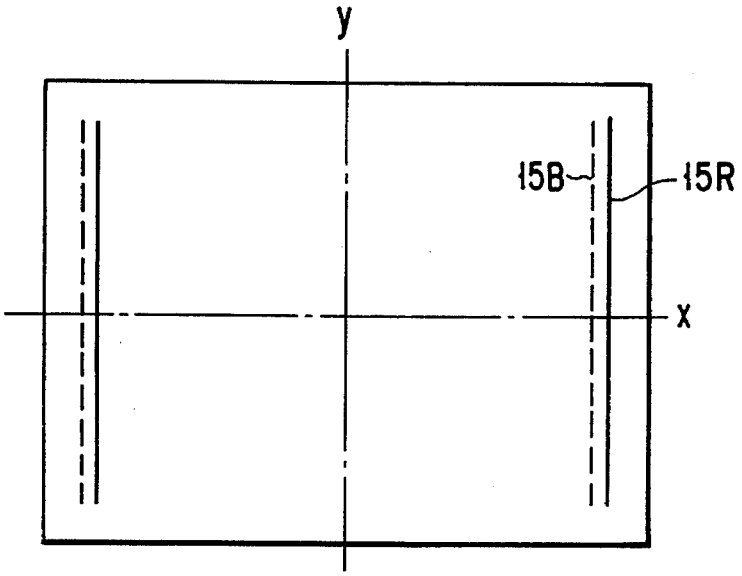
FIG. 9 is a diagram illustrating the mis-convergence caused by the magnetic field generated by the first coil of the deflection device shown in FIGS. 8A and 8B.

As shown in FIGS. 8A and 8B, an additional coil assembly 51 is located in the plane containing the vertical axis (y axis) and center axis (z axis) of a deflection yoke 27. In other words, the assembly 5 is positioned near the neck of the envelope of the cathode-ray tube in which the device is to be used. The additional coil assembly 51 comprises a pair of coils 24A and another pair of coils 24B. The coils 24B of the first pair are connected to the horizontal deflection coils 21. Currents flow in the coils 24A in synchronism with, and in the opposite direction to, those currents flowing in the horizontal deflecting coils 21. The coils 24A of the second pair are located adjacent to the coils 24B, at the front of the deflection yoke 27 (that is, within the large-diameter end of the funnel of the envelope). Currents flow in these coil 24B in synchronism with, and in the same direction as, the currents flowing in the horizontal deflecting coils 21.

The coils 24A and the coils 24B are connected together, in end-to-end fashion, forming a coil unit. Each pair of coils of the assembly 51 is formed by winding an insulated wire, forming an annular coil having about five turns, by flattening the annular coil into an elongated one, and by twisting the elongated coil 180° at the middle portion thereof.

Referring back to FIG. 6, the horizontal deflection coils 21 generate horizontal deflection magnetic fields 12H in a deflection region in which the three electron beams 7B, 7G, and 7R emitted from the electron gun unit of the cathode-ray tube are travelled. Simultaneously, the coils 24B of the first pair generate magnetic fields 26 in the same deflection region. The magnetic field generated by either coil 24B is a local one. Therefore, the beams 7B, 7G, and 7R are deflected in different directions which are determined by the positions they take with respect to the magnetic field generated by the coil 24B.

When the beams 7B, 7G, and 7R are deflected in the deflection region (FIG. 6) by the vertical deflection magnetic field 12V and the horizontal deflection magnetic field 12H and are applied toward a position between the vertical axis of the screen of the cathode-ray tube and any corner of the screen, the magnetic field 26 generated by each coil 24B deflects the side electron beam 7B more toward the horizontal axis (x axis) of the screen as indicated by an arrow 32 than the other side beam 7R is deflected toward the horizontal axis of the screen as indicated by an arrow 33. On the other hand, when the beams 7B, 7G, and 7R are deflected in the deflection region (FIG. 6) by the vertical and horizontal deflection magnetic fields 12V and 12H and are applied toward any corner of the display screen, the magnetic field 26 generated by each coil 24B deflects the side electron beam 7B more away from, and the other side beam 7R more toward, the horizontal axis (x axis) of the screen than in the case where the beams 7B, 7G, and 7R are deflected toward a position between the vertical axis of the screen and any corner of thereof.

When the electron beams 7B, 7G, and 7R are deflected toward an upper-right position on the display screen by the vertical and horizontal deflection magnetic fields 12V and 12H, the magnetic field 26 generated by each coil 24B deflects the side electron beams 7B and 7R in a relation reverse to that relation which the beams 7B and 7R have when the beams 7B, 7G, and 7R are deflected toward an upper-left position on the display screen. When the electron beams 7B, 7G, and 7R are deflected toward a lower position of the display screen by the deflection magnetic fields 12v and 12H, the magnetic field 26 generated by each coil 24B deflects the side electron beams 7B and 7R in the same way as in the case where the beams 7B, 7G, and 7R are deflected toward an upper-left position on the screen or toward the upper-right position of the screen. Hence, the vertical mis-convergence at a position between the vertical axis of the screen and any corner thereof can be reduced, without jeopardizing the convergence at the corner of the display screen.

When the coils 24B are energized, however, a current flowing in the opposite direction to the horizontal deflection currents flowing in the coils 24B reduce the intensity of the pincushion-shaped horizontal deflection magnetic field 12H. Consequently, horizontal mis-convergence of the side beams 7B and 7R occurs as is indicated by the side-beam patterns 15B and 15R shown in FIG. 9. Nonetheless, this horizontal mis-convergence of the side beams is minimized since the currents, which flow in the coils 24A of the second pair in the same direction as the currents flowing in the horizontal deflection coils 21, intensify the pincushion-shaped horizontal deflection magnetic field 12H at the region near the front end of the deflection yoke 26.

In the deflection device of FIGS. 8A and 8B, the coils 24A and the coils 24B form an integral unit, i.e., the additional coil assembly 51. The assembly 51 is relatively simple in structure and can yet minimize the vertical mis-convergence at a position between the vertical axis of the screen and any corner thereof.

As described above, the coils 24A and the coils 24B, which constitute the additional coil assembly 51, are positioned in the plane containing the center and vertical axes of the deflection yoke 26. It is desirable that the coils 24A and 24B be located at a distance of 10 mm or less from that plane.

Figure 10:
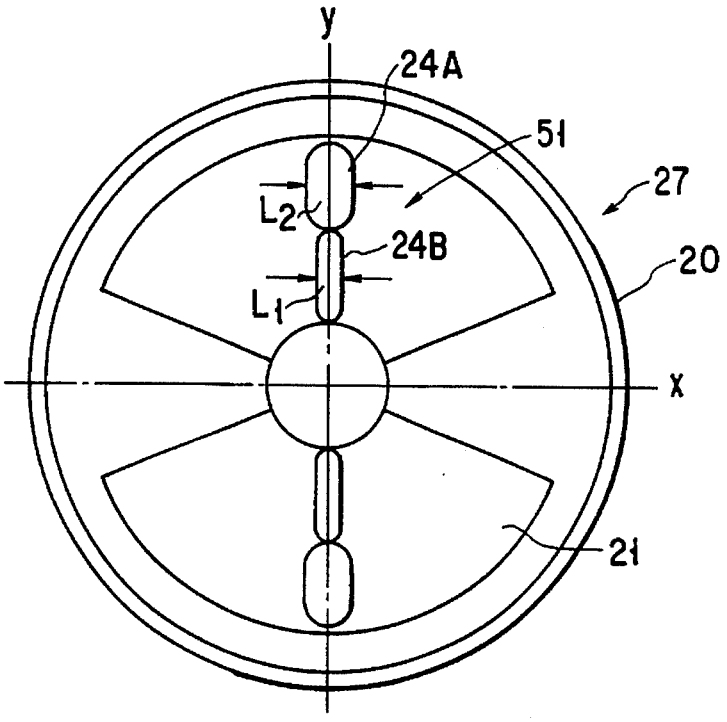
FIG. 10 is a front view showing a modification of the deflection device shown in FIGS. 8A and 8B.

In the deflection device shown in FIG. 8A and 8B, the coils 24B of the first pair and the coils 24A of the second pair are of the same shape and the same size. Instead, as is shown in FIG. 10, the coils 24A may have a width $L_2$, and the coils 24B may have a width $L_1$, each measured in the horizontal direction, where $L_1<L_2$. In this case, it is possible to adjust the ratio of improvement of the vertical mis-convergence, occurring at an intermediate position between the vertical axis of the screen and any corner thereof to the horizontal mis-convergence.

As has been indicated, in the embodiment of FIGS. 8A and 8B, the coils 24B, in which currents flow in synchronism with and in the opposite direction to those currents flowing in the horizontal deflecting coils 21, are located in the plane containing the center and vertical axes of the screen and at the rear of the deflection yoke 26; and the coils 24A, in which currents flow in synchronism with and in the same direction as the currents flowing in the horizontal deflecting coils 21, are located in that plane and at the front of the deflection yoke 17. The coils 24B generate a magnetic field which reduces the vertical mis-convergence of the side beam occurring at a position between the vertical axis of the screen and any corner thereof. The coils 24A generate a magnetic field which minimizes the horizontal mis-convergence caused by the magnetic field generated by the coils 24B. As a result, sufficient convergence of the three beams 7B, 7G, and 7R can be maintained at any position on the display screen of the cathode-ray tube.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A deflection device for use in a color cathode-ray tube having a center axis and means for emitting in-line electron beams, the deflection device comprising:

horizontal deflection means for deflecting the electron beams in a horizontal direction in response to horizontal deflection signals, the horizontal deflection means including a pair of horizontal deflection coils for generating a pincushion-shaped horizontal deflection magnetic field;

vertical deflection means for deflecting the electron beams in a vertical direction in response to vertical deflection signals, the vertical deflection means including a pair of vertical deflection coils for generating a barrel-shaped vertical deflection magnetic field; and correction means for correcting the deflection of the electron beams by applying a correction magnetic field to the electron beams in response to the horizontal deflection signals, the correction means including a pair of correction coils which are located near and symmetric with respect to a vertical axis and orthogonal to the center axis, wherein currents flow through the correction coils in synchronism with, and in a direction opposite to, the currents flowing in the horizontal deflection coils, each of the correction coils being arranged within 10 mm from a plane which is defined by the vertical direction and the center axis of the cathode ray tube.

2. The deflection device according to claim 1, wherein the horizontal deflection coils are saddle-shaped.

3. A deflection device for use in a color cathode-ray tube having a center axis and means for emitting in-line electron beams, the deflection device comprising:

horizontal deflection means for deflecting the electron beams in a horizontal direction in response to horizontal deflection signals, the horizontal deflection means including a pair of horizontal deflection coils for generating a pincushion-shaped horizontal deflection magnetic field;

vertical deflection means for deflecting the electron beams in a vertical direction in response to vertical deflection signals, the vertical deflection means including a pair of vertical deflection coils for generating a barrel-shaped vertical deflection magnetic field; and correction means for correcting the deflection of the electron beams by applying a correcting magnetic field to the electron beams in response to the horizontal deflection signals, the correction means including:

a first pair of correction coils which are located near and symmetric with respect to a vertical axis, orthogonal to the center axis, where currents flow through the correction coils in synchronism with, and in a direction opposite to, the currents flowing in the horizontal deflection coils, and a second pair of correction coils which are located near and symmetric with respect to the vertical axis, where currents flow in synchronism with, and in the same direction as, the currents flowing in the horizontal deflection coils.

4. The deflection device according to claim 3, wherein the horizontal deflection coils are saddle-shaped.

5. The deflection device according to claim 3, wherein the correction coils of the first pair are arranged between the second pair of correction coils and the means for emitting in-line electron beams.

* * * * *